US008452600B2

(12) United States Patent
Fleizach

(10) Patent No.: US 8,452,600 B2
(45) Date of Patent: May 28, 2013

(54) ASSISTED READER

(75) Inventor: Christopher B. Fleizach, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 207 days.

(21) Appl. No.: 12/859,158

(22) Filed: Aug. 18, 2010

(65) Prior Publication Data

US 2012/0046947 A1 Feb. 23, 2012

(51) Int. Cl.
*G10L 13/08* (2006.01)

(52) U.S. Cl.
USPC ..... 704/260; 704/258; 704/270

(58) Field of Classification Search
USPC ..... 704/258, 260, 270, 271, 272, 276
See application file for complete search history.

(56) References Cited

U.S. PATENT DOCUMENTS

| | | | | |
|---|---|---|---|---|
| 4,746,770 | A | 5/1988 | McAvinney | |
| 5,053,758 | A | 10/1991 | Cornett et al. | |
| 5,502,803 | A | 3/1996 | Yoshida et al. | |
| 5,761,485 | A | 6/1998 | Munyan | |
| 5,832,528 | A | 11/1998 | Kwatinetz et al. | |
| 5,943,043 | A | 8/1999 | Furuhata et al. | |
| 6,046,722 | A | 4/2000 | McKiel, Jr. | |
| 6,088,023 | A | 7/2000 | Louis et al. | |
| 6,115,482 | A | 9/2000 | Sears et al. | |
| 6,128,007 | A | 10/2000 | Seybold | |
| 6,211,856 | B1 | 4/2001 | Choi et al. | |
| 6,246,983 | B1 * | 6/2001 | Zou et al. | 704/260 |
| 6,384,743 | B1 | 5/2002 | Vanderheiden | |
| 6,396,523 | B1 | 5/2002 | Segal et al. | |
| 6,442,523 | B1 * | 8/2002 | Siegel | 704/270 |
| 6,446,041 | B1 * | 9/2002 | Reynar et al. | 704/260 |
| 6,466,203 | B2 | 10/2002 | Van Ee | |
| 6,489,951 | B1 | 12/2002 | Wong et al. | |
| 6,765,557 | B1 | 7/2004 | Segal et al. | |
| 6,926,609 | B2 | 8/2005 | Martin | |
| 7,062,437 | B2 * | 6/2006 | Kovales et al. | 704/260 |
| 7,187,394 | B2 | 3/2007 | Chandane | |
| 7,376,523 | B2 | 5/2008 | Sullivan et al. | |
| 7,408,538 | B2 | 8/2008 | Hinckley et al. | |
| 7,479,949 | B2 | 1/2009 | Jobs et al. | |
| 7,603,621 | B2 | 10/2009 | Toyama et al. | |
| 7,637,421 | B1 | 12/2009 | Trocme | |
| 8,059,101 | B2 | 11/2011 | Westerman et al. | |

(Continued)

FOREIGN PATENT DOCUMENTS

| | | |
|---|---|---|
| DE | 43 40 679 | 6/1995 |
| JP | 7 321889 | 12/1995 |
| WO | WO 92/08183 | 5/1992 |

OTHER PUBLICATIONS

American Thermoform Corp., "Touch Screen, Talking Tactile Tablet," downloaded Jul. 30, 2008, http://www.americanthermoform.com/tactiletablet.htm, 2 pages.

(Continued)

*Primary Examiner* — Douglas Godbold
(74) *Attorney, Agent, or Firm* — Morgan, Lewis & Bockius LLP

(57) ABSTRACT

An electronic reading device for reading ebooks and other digital media items combines a touch surface electronic reading device with accessibility technology to provide a visually impaired user more control over his or her reading experience. In some implementations, the reading device can be configured to operate in at least two modes: a continuous reading mode and an enhanced reading mode.

36 Claims, 7 Drawing Sheets

U.S. PATENT DOCUMENTS

| | | | | |
|---|---|---|---|---|
| 8,103,554 | B2 * | 1/2012 | Tom | 705/26.1 |
| 2002/0133350 | A1 * | 9/2002 | Cogliano | 704/270 |
| 2003/0046082 | A1 * | 3/2003 | Siegel | 704/270 |
| 2004/0263491 | A1 | 12/2004 | Ishigaki | |
| 2005/0134578 | A1 | 6/2005 | Chambers et al. | |
| 2005/0216867 | A1 | 9/2005 | Marvit et al. | |
| 2006/0119588 | A1 | 6/2006 | Yoon et al. | |
| 2006/0230340 | A1 | 10/2006 | Parsons et al. | |
| 2007/0011011 | A1 * | 1/2007 | Cogliano | 704/272 |
| 2007/0033543 | A1 | 2/2007 | Ngari et al. | |
| 2007/0230748 | A1 * | 10/2007 | Foss | 382/114 |
| 2007/0236475 | A1 | 10/2007 | Wherry | |
| 2007/0262964 | A1 | 11/2007 | Zotov et al. | |
| 2007/0268317 | A1 | 11/2007 | Banay | |
| 2008/0027726 | A1 * | 1/2008 | Hansen et al. | 704/260 |
| 2008/0114599 | A1 * | 5/2008 | Slotznick et al. | 704/260 |
| 2008/0122796 | A1 | 5/2008 | Jobs et al. | |
| 2008/0140413 | A1 * | 6/2008 | Millman et al. | 704/270 |
| 2008/0165141 | A1 | 7/2008 | Christie | |
| 2008/0300874 | A1 * | 12/2008 | Gavalda et al. | 704/235 |
| 2008/0316183 | A1 | 12/2008 | Westerman et al. | |
| 2009/0303187 | A1 | 12/2009 | Pallakoff | |
| 2009/0313020 | A1 * | 12/2009 | Koivunen | 704/260 |
| 2010/0001953 | A1 | 1/2010 | Yamamoto et al. | |
| 2010/0063880 | A1 * | 3/2010 | Atsmon et al. | 705/14.53 |
| 2010/0070281 | A1 * | 3/2010 | Conkie et al. | 704/260 |
| 2010/0231541 | A1 * | 9/2010 | Cruz-Hernandez et al. | 345/173 |
| 2010/0283742 | A1 | 11/2010 | Lam | |
| 2010/0289757 | A1 * | 11/2010 | Budelli | 345/173 |
| 2010/0309147 | A1 | 12/2010 | Fleizach et al. | |
| 2010/0309148 | A1 | 12/2010 | Fleizach et al. | |
| 2010/0313125 | A1 | 12/2010 | Fleizach et al. | |
| 2010/0324903 | A1 * | 12/2010 | Kurzweil et al. | 704/260 |
| 2011/0050594 | A1 * | 3/2011 | Kim et al. | 345/173 |
| 2011/0264452 | A1 * | 10/2011 | Venkataramu et al. | 704/260 |
| 2011/0298723 | A1 | 12/2011 | Fleizach et al. | |
| 2011/0302519 | A1 | 12/2011 | Fleizach et al. | |
| 2011/0310026 | A1 * | 12/2011 | Davis et al. | 345/173 |

OTHER PUBLICATIONS

Apple.com, "VoiceOver," May 2009, http://www.apple.com/accessibility/vocieover, 5 pages.

Apple Inc., "iPad User Guide," Apple Inc., © 2010, 154 pages.

appshopper, "GDial Free—Speed Dial with Gesture," appshopper.com, Mar. 25, 2009, http://appshopper.com/utilities/gdial-free-speed-dial-with-gesture, 2 pages.

CNET, "Sony Ericsson W910," posts, the earliest of which is Oct. 17 2007, 4 pages, http://news.cnet/crave/?keyword=Sony+Ericsson+W910.

Esther, "GarageBand," AppleVis, Mar. 11, 2011, http://www.applevis.com/app-directory/music/garageband, 4 pages.

Immersion, "Haptics: Improving the Mobile User Experience through Touch" Immersion Corporation White Paper, © 2007 Immersion Corporation, 12 pages http://www.immersion.com/docs/haptics_mobile-ue_nov07v1.pdf.

Jaques, R., "HP unveils Pocket PC for blind users," vnunet.com, Jul. 5, 2004, http://www.vnunet.com/vnunet/news/2125404/hp-unveils-pccket-pc-blind-users, 3 pages.

joe. "Gesture cornrnander-Amazinq feature exclusive to Dolphin Browser," doiphin-browser.com, Jul. 27, 2010, http://dolphin-browser.com/2010/07/amazing-feature-exclusive-to-dolphin-browser-gesture-commander/, 3 pages.

Kane et al., "Slide Rule: Making Mobile Touch Screens Accessible to Blind People Using Multi-Touch Interaction Techniques," Proceedings of ACM SIGACCESS Conference on Computers and Accessibility, Halifax, Nova Scotia, Canada, Oct. 2008, 8 pages.

Kendrick,D., "The Touch That Means So Much: Training Materials for Computer Users Who Are Deaf-Blind," AFB AccessWold, Mar. 2005, vol. 6, No. 2, http://www.afb.org/afbpress/pub.asp?DocID=aw060207, 9 pages.

Microsoft, "Pocket PC Device for Blind Users Debuts during National Disability Employment Awareness Month," Microsoft.com PressPass, Oct. 18, 2002, http://www.microsoft.com/presspass/features/2002/oct02/10-16ndeam.mspx, 4 pages.

Okada et al., "CounterVision: A Screen Reader with Multi-Access Interface for GUI," Proceedings of Technology And Persons With Disabilities Conference, Center On Disabilities, CSU Northridge, Mar. 1997, http://www.csun.edu/cod/conf/1997/proceedings/090.htm, 6 pages.

Raman, T., "Eyes-Free User interation," Google Research, Feb. 9, 2009, http://emacspeak.sf.net/raman, 25 pages.

tiresias.org, "Touchscreens," tiresias.org, Jul. 15, 2008, http://www.tiresias.org/research/guidelines/touch/htm.

Touch Usability, "Mobile," Mar. 12, 2009, http://www.touchusability.com/mobile/, 9 pages.

Vanderheiden, G., "Use of audio-haptic interface techniques to allow non-visual access to touchscreen appliances," Sep. Oct. 1995, http://trace.wisc.edu/docs/touchscreen/chi_conf.htm. 9 pages.

Extended Search Report dated Sep. 27, 2012, received in European Patent Application No. 12154609.7, which corresponds to U.S. Appl. No. 12/565,744, 7 pages (Fleizach).

European Search Report and Written Opinion dated Jun. 29, 2012, received in European Patent Application No. 12154613.9, which corresponds to U.S. Appl. No. 12/565,744, 7 pages (Fleizach).

International Search Report and Written Opinion dated Jun. 22, 2011, received in International Application No. PCT/US2010/034109, which corresponds to U.S. Appl. No. 12/565,744, 17 pages (Fleizach).

International Search Report and Written Opinion dated Aug. 30, 2012, received in International Application No. PCT/US2012/040703, which corresponds to U.S. Appl. No. 13/221,833, 11 pages (Fleizach).

Office Action dated May 25, 2012, received in U.S. Appl. No. 12/565,744, 16 pages (Fleizach).

Final Office Action dated Dec. 6, 2012, received in U.S. Appl. No. 12/565,744, 18 pages (Fleizach).

Office Action dated Nov. 20, 2012, received in European Patent Application No. 10719502.6, which corresponds to U.S. Appl. No. 12/565,744, 5 pages (Fleizach).

Office Action dated Jul. 12, 2012, received in U.S. Appl. No. 12/565,745, 8 pages (Fleizach).

Notice of Allowance dated Nov. 26, 2012, received in U.S. Appl. No. 12/565,745, 9 pages (Fleizach).

Office Action dated Dec. 21, 2011, received in U.S. Appl. No. 12/795,633, 9 pages (Fleizach).

Office Action dated Aug. 30, 2012, received in U.S. Appl. No. 12/795,633, 13 pages (Fleizach).

Frantz et al., "Design case history: Speak & Spell learns to talk," IEEE spectrum, Feb. 1982, 5 pages.

Law et al., "Ez Access Strategies for Cross-Disability Access to Kiosks, Telephones and VCRs," DINF (Disability Information Resources), Feb. 16, 1998, http://www.dinf.ne.jp/doc/english/Us_Eu/conf/csun_98/csun98_074.html, 6 pages.

Vanderheiden, G., "Universal Design and Assistive Technology in Communication and Information Technologies: Alternatives or Complements?" Assistive Technology: The Official Journal of RESNA, 1998, vol. 10, No. 1, 9 pages.

Vintage, "TSI Speech + & other speaking calculators," Vintage Calculators Web Museum, retrieved from the internet May 4, 2012, http://www.vintagecalculators.com/html/speech_.html, 6 pages.

* cited by examiner

ASSISTED READER

TECHNICAL FIELD

This disclosure relates generally to electronic book readers and accessibility applications for visually impaired users.

BACKGROUND

A conventional electronic book reading device ("ebook reader") enables users to read electronic books displayed on a display of the ebook reader. Visually impaired users, however, often require additional functionality from the ebook reader in order to interact with the ebook reader and the content displayed on its display. Some modern ebook readers provide a continuous reading mode where the text of the ebook is read aloud to a user, e.g., using synthesized speech. The continuous reading mode, however, may not provide a satisfying reading experience for a user, particularly a visually impaired user. Some users will desire more control over the ebook reading experience.

SUMMARY

An electronic reading device for reading ebooks and other digital media items (e.g., .pdf files) combines a touch surface electronic reading device with accessibility technology to provide a user, in particular, a visually impaired user, more control over his or her reading experience. In some implementations, the electronic reading device can be configured to operate in at least two assisted reading modes: a continuous assisted reading mode and an enhanced assisted reading mode.

In some implementations, a method performed by one or more processors of an assisted reading device includes providing a user interface on a display of the assisted reading device, the user interface displaying text and configured to receive touch input for selecting a continuous assisted reading mode or an enhanced assisted reading mode. The method further includes receiving first touch input selecting a line of text to be read aloud, determining that the enhanced assisted reading mode is selected based on the first touch input, and invoking the enhanced assisted reading mode. The method further includes outputting audio for each word in the selected line.

In some implementations, a method performed by one or more processors of the assisted reading device includes receiving first user input to a device, the first user input selecting a first presentation granularity for content presented by the device, and storing data indicating that the first presentation granularity was selected. The method further includes receiving second user input to the device, the second user input requesting presentation of the content, and presenting the content according to the first presentation granularity.

In some implementations, a method performed by one or more processors of the assisted reading device includes displaying content on a display of a device, wherein the content is displayed as lines of content each having a location on the display. The method further includes receiving user input at a first location on the device, and in response to the user input, identifying one of the lines of content having a location corresponding to the first location. The method further includes presenting audio corresponding to the identified line of content and not presenting audio corresponding to any of the other lines of content.

These features provide a visually impaired user with additional accessibility options for improving his or her reading experience. These features allow a user to control the pace and granularity level of the reading using touch inputs. Users can easily and naturally change between an enhanced and a continuous reading mode.

Other implementations of the assisted reader can include systems, devices and computer readable storage mediums. The details of one or more implementations of the assisted reader are set forth in the accompanying drawings and the description below. Other features, aspects, and advantages will become apparent from the description, the drawings, and the claims.

BRIEF DESCRIPTION OF THE DRAWINGS

Like reference symbols in the various drawings indicate like elements.

DETAILED DESCRIPTION

Overview of Assisted Reading Device

Figure 1A:
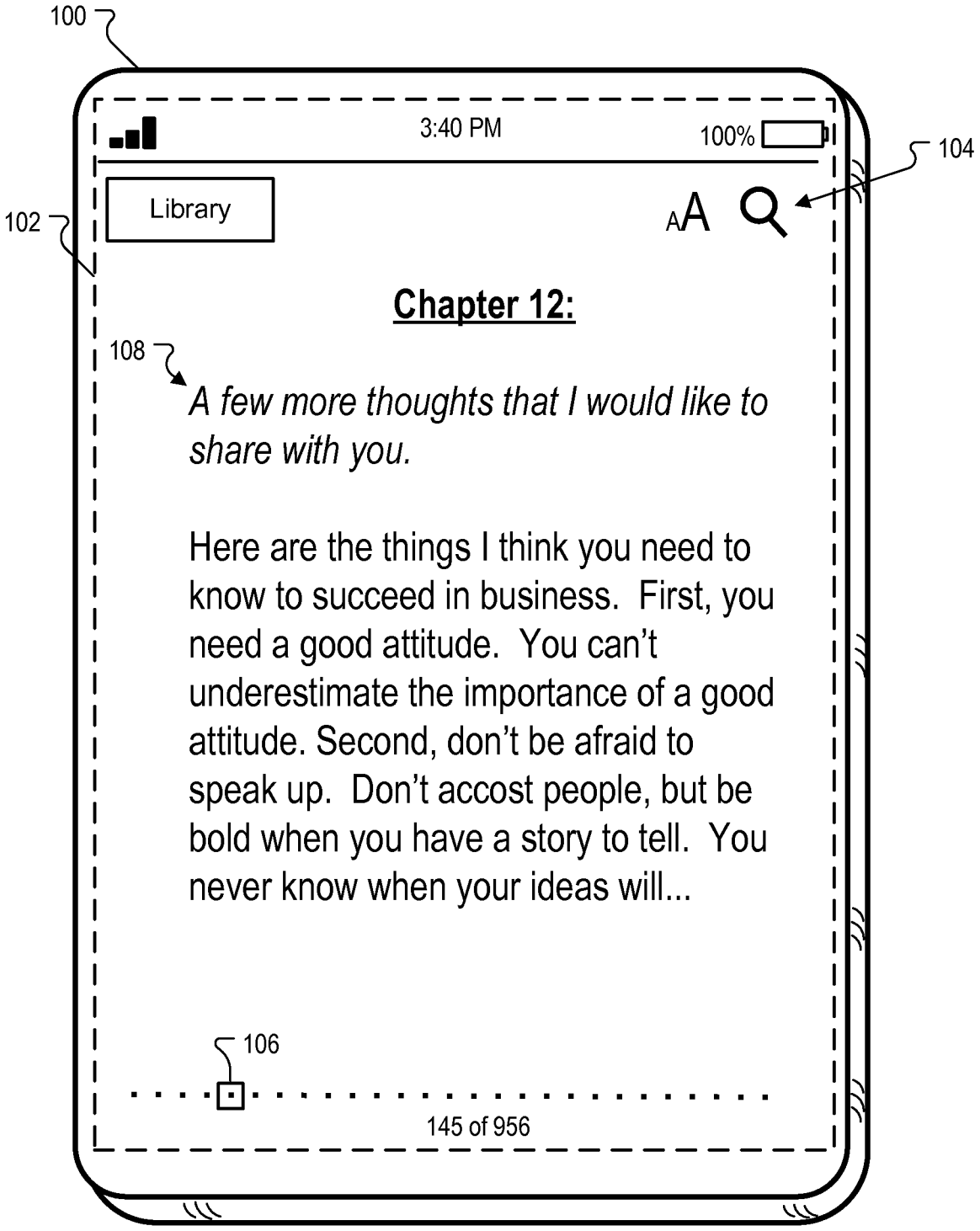
FIG. 1A illustrates an exemplary user interface of an assisted reading device.

FIG. 1A illustrates an exemplary user interface of assisted reading device 100 for digital media items. In general, an assisted reading device is an electronic device that assists disabled users, e.g., visually impaired users, to interact with the content digital media items presented by the device. A device provides assisted reading of digital media items by presenting the texts of the digital media items in a format that is accessible to the user. For example, if a user is visually impaired, an assisted reading device can present audio, e.g., synthesized speech, corresponding to the text of an electronic document. The text can include any textual content, including but not limited to text of the document, captions for images, section or chapter titles, and tables of contents. The audio can be presented, for example, through a loudspeaker integrated in or coupled to assisted reading device 100, or through a pair of headphones coupled to a headphone jack of assisted reading device 100.

In some implementations, assisted reading device 100 can be a portable computer, electronic tablet, electronic book reader or any other device that can provide assisted reading of electronic documents. In some implementations, assisted reading device 100 can include a touch sensitive display or surface (e.g., surface 102) that is responsive to touch input or gestures by one or more fingers or another source of input, e.g., a stylus.

In the example shown in FIG. 1A, Chapter 12 of an ebook is displayed on touch sensitive surface 102 of assisted reading device 100. The user interface of assisted reading device 100 includes one or more controls for customizing the user's interactions with the displayed content. For example, one or more controls 104 can be used to magnify portions of text or to adjust the size or font of the text. As another example, control 106 can be used to move through pages of the ebook. For example, a user can touch control 106 and make a sliding gesture to the to left or right to move through pages of the ebook.

In some implementations, assisted reading device 100 can be configured to operate in at least two assisted reading modes: a continuous reading mode and an enhanced reading mode. The continuous reading mode reads content continuously (e.g., using speech synthesization or other conventional techniques), until the end of the content is reached or the user stops or pauses the reading. The enhanced reading mode provides the user with a finer granularity control over his or her experience in comparison to the continuous reading mode.

The user can enter the continuous reading mode by providing a first touch input (e.g., a two finger swipe down gesture) on touch sensitive surface 102 of assisted reading device 100. Once the device is in the continuous reading mode, the content can be automatically presented to the user. The user can start and stop presentation of the content using other touch inputs (e.g., a double tap touch input to start the presentation and a finger down on touch surface to stop or pause the presentation). During presentation of the content, audio corresponding to the text of the content is presented. For example, a synthesized speech generator in assisted reading device 100 can continuously read a digital media item aloud, line by line, until the end of the digital media item is reached or until the user stops or pauses the reading with a touch input.

When the speech synthesizer reaches the end of the current page, the current page is automatically turned to the next page, and the content of the next page is read aloud automatically until the end of the page is reached. Assisted reading device 100 turns the page by updating the content displayed on display 102 to be the content of the next page, and presenting the content on that page to the user. Assisted reading device 100 can also provide an audio cue to indicate that a page boundary has been crossed because of a page turn (e.g., a chime) or that a chapter boundary has been crossed (e.g., a voice snippet saying "next chapter"). In some implementations, the audio cue is presented differently from the spoken text. For example, the audio cue can be in a different voice, a different pitch, or at a different volume than the spoken text. This can help a user distinguish between content being spoken and other information being provided to the user.

In some implementations, the language of the speech used by device 100 during continuous reading mode is automatically selected based on the content of the digital media item. For example, the digital media item can have associated formatting information that specifies the language of the content. Device 100 can then select an appropriate synthesizer and voice for the language of the content. For example, if the digital media item is an ebook written in Spanish, the device 100 will generate speech in the Spanish language, e.g., using a Spanish synthesizer and Spanish voice that speaks the words with the appropriate accent. In some implementations, the formatting information can also specific a particular regional format (e.g., Spanish from Spain, or Spanish from Mexico), and the appropriate synthesizer and voice for that region can be used.

In the enhanced reading mode, the user is provided with a finer level of control over his or her reading experience than the user has in the continuous reading mode. For example, in the enhanced reading mode, a page of the digital media item can be read line by line by the user manually touching each line. The next line is not read aloud until the user touches the next line. This allows the user to manually select the line to be read aloud and thus control the pace of his or her reading. For example, the user can touch line 108 and the words in line 108 will be synthesized into speech and output by device 100. If the digital media item contains an image with a caption, the caption can be read aloud when the user touches the image.

The user can turn to the previous or next page by making a left, right, up or down touch gesture (e.g., a three finger swipe gesture). The direction of the gesture can depend on whether pages scroll from top to bottom or left to right, from the perspective of a user facing the display of device 100. An audio cue can be provided to indicate a page turn or a chapter boundary, as described in more detail above. When the user makes a gesture associated with the enhanced reading mode, the device interprets the input as a request that the device be placed in the enhanced reading mode and that the requested feature be invoked.

In the enhanced reading mode, a user can also step through the content at a user-specified granularity, as described in more detail below with reference to FIG. 1B.

Figure 1B:
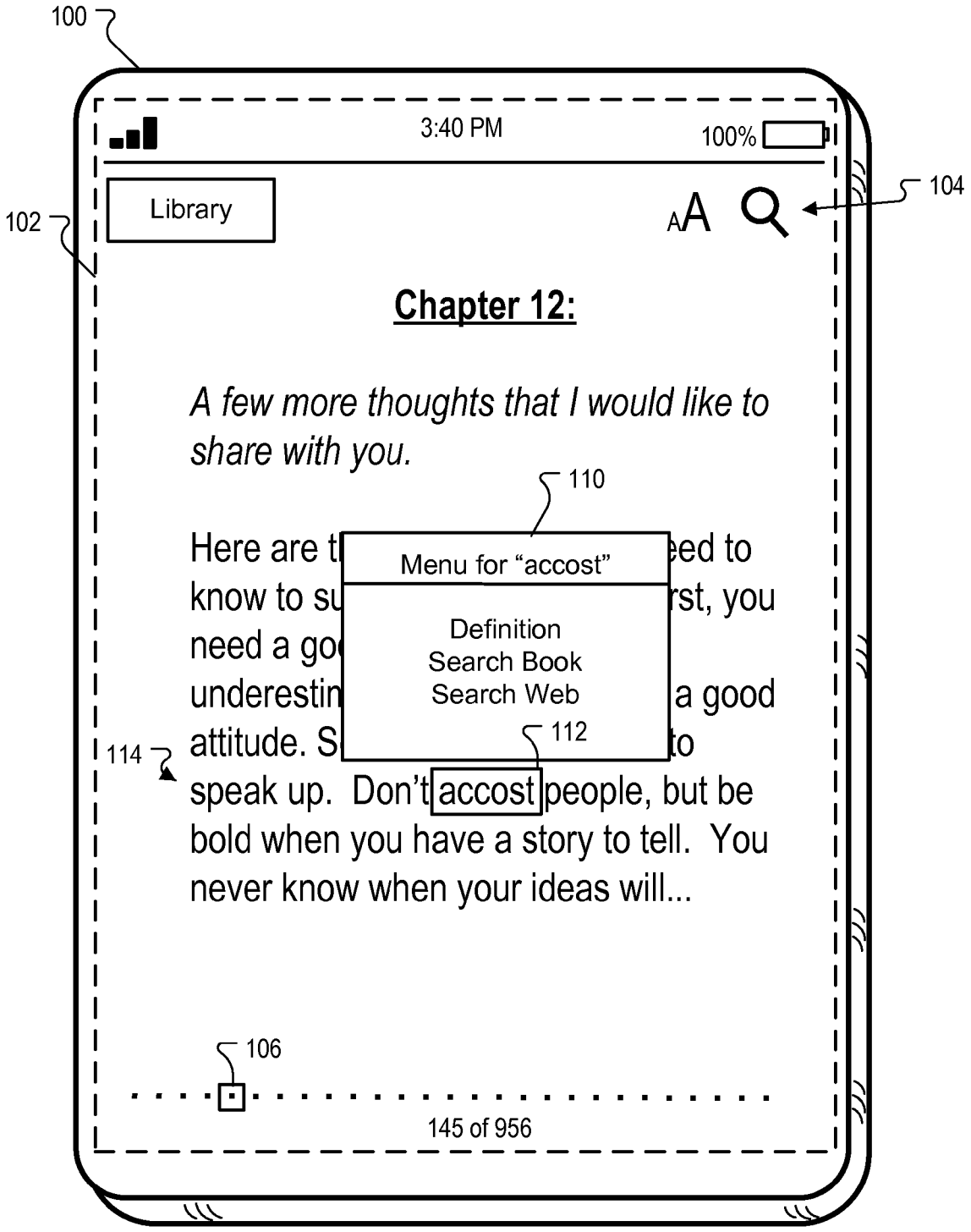
FIG. 1B illustrates the user interface of FIG. 1A, including selecting options associated with a word.

FIG. 1B illustrates the user interface of FIG. 1A, when the user is in the enhanced reading mode. In the enhanced reading mode, if the user desires finer control over his or her reading experience, the user can invoke a granularity control for the desired level of granularity. The granularity control can have at least three modes: sentence mode, word mode, and character mode. Other modes, for example, phrase mode and paragraph mode, can also be included. In some implementations, the modes can be selected with rotation touch gesture on surface 102, as if turning a virtual knob or dial. Other touch input gestures can also be used.

In the example shown, the user has selected word mode. In word mode, the user can provide a touch input to step through the content displayed on display 102 word by word. With each touch input, the appropriate item of content (word) is read aloud. The user can step forwards and backwards through the content.

When the user hears a desired word read aloud, the user can provide a first touch input (e.g., a single tap) to get a menu with options. In the example shown in FIG. 1B, the word is "accost" and a menu 110 is displayed with the options to get a definition of the selected word, e.g., from a dictionary, to invoke a search of the text of the document using the selected word as a query, or invoke a search of documents accessible over a network, e.g., the web, using the selected word as a query. While menu 110 is graphically shown on display 102 in FIG. 1B, assisted reading device 100 can alternatively or additionally present the menu to the user, for example, by presenting synthesized speech corresponding to the options of the menu.

Example Methods to Provide Assisted Reading Functionality to a User

Figure 2:
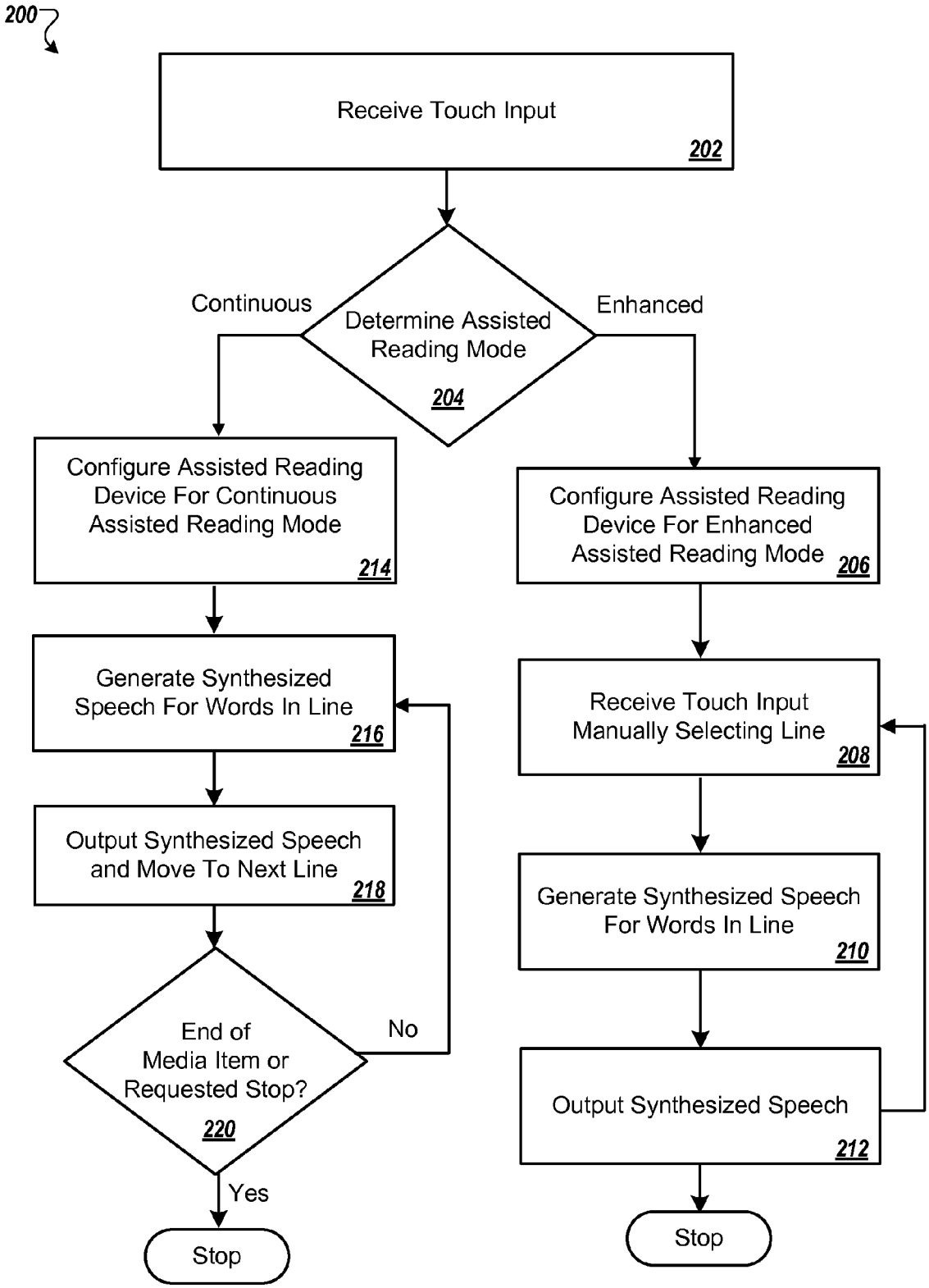
FIG. 2 is a flow diagram of an accessibility process for allowing users to switch between continuous and enhanced reading modes.

FIG. 2 is a flow diagram of an accessibility process 200. Accessibility process 200 is performed, for example, by assisted reading device 100 described above with reference to FIGS. 1A and 1B.

In some implementations, process 200 can begin by receiving touch input (202). Based on the touch input received, an assisted reading mode is determined (204). In some implementations, the user can enter the continuous reading mode with a two finger swipe down gesture on a touch sensitive surface (e.g., surface 102) of the reading device (e.g., device 100) and can enter the enhanced reading mode by making a gesture associated with one of the features of the enhanced reading mode.

If the reading mode is determined to be the continuous assisted reading mode, the device 100 can be configured to operate in the continuous assisted reading mode (214). In some implementations, once in the continuous assisted reading mode, the user can start the reading aloud of content, for example, using a double tap touch input as described above with reference to FIG. 1A. In other implementations, the reading aloud begins automatically once the device is in the continuous assisted reading mode.

Each word of each line of the text of the currently displayed page of the digital media item is synthesized into speech (216) and outputted (218) until the end of the current page is reached. Alternatively, other forms of audio other than synthesized speech can also be used.

At the end of the current page, the current page is automatically turned to the next page (e.g., updated to be the next page), and text on the next page is read aloud automatically until the end of the page is reached. An audio cue can be provided to indicate a page turn (e.g., a chime) or a chapter boundary (e.g., a voice snippet saying "next chapter" or identifying the chapter number, e.g., "chapter 12"). The continuous reading of text continues until the end of the digital media item is reached or until the user provides a third touch input to stop or pause the reading aloud of the content (220). In some implementations, the user gestures by placing a finger down on a touch surface of the device to stop or pause the reading aloud of the content. The user can resume the reading by, for example, providing a double tap touch input.

If the reading mode is determined to be the enhanced assisted reading mode, the device can be configured to operate in an enhanced reading mode (206). In the enhanced reading mode, the user is provided with a finer level of control over his or her reading experience. When input from a user manually touching the desired line is received (208), a line of text in a page of the digital media item can be read to the user. The device maps the location of the touch input to a location associated with one of the lines of text displayed on the display. The touched line, and only the touched line, is synthesized into speech (210) and output (212) through a loudspeaker or headphones. The user can then touch another line to have that line spoken aloud. Thus, the enhanced assisted reading mode allows the user to manually select the line to be read aloud, thereby controlling the pace of his or her reading.

The device can determine what text should be read aloud when a line is touched as follows. First, the device maps the location touched by the user to data describing what is currently displayed on the screen in order to determine that content, rather than some other user interface element, was touched by the user. Then, the device identifies the item of content touched by the user, and determines the beginning and end of the line of content. For example, the device can access metadata for the content that specifies where each line break falls.

In enhanced assisted reading mode, the user can turn to the previous or next page by making a left, right, up or down touch gesture (e.g., a three finger swipe gesture), depending on whether pages scroll from top to bottom or left to right, from the perspective of a user facing the display of device 100. If the digital media item contains an image with a caption, the caption can be read aloud when the user touches the image. An audio cue can be provided to indicate a page turn (e.g., a chime) or a chapter boundary (e.g., a voice snippet saying "next chapter").

In enhanced assisted reading mode, a user can also specify the granularity with which he or she wants content to be presented.

Figure 3:
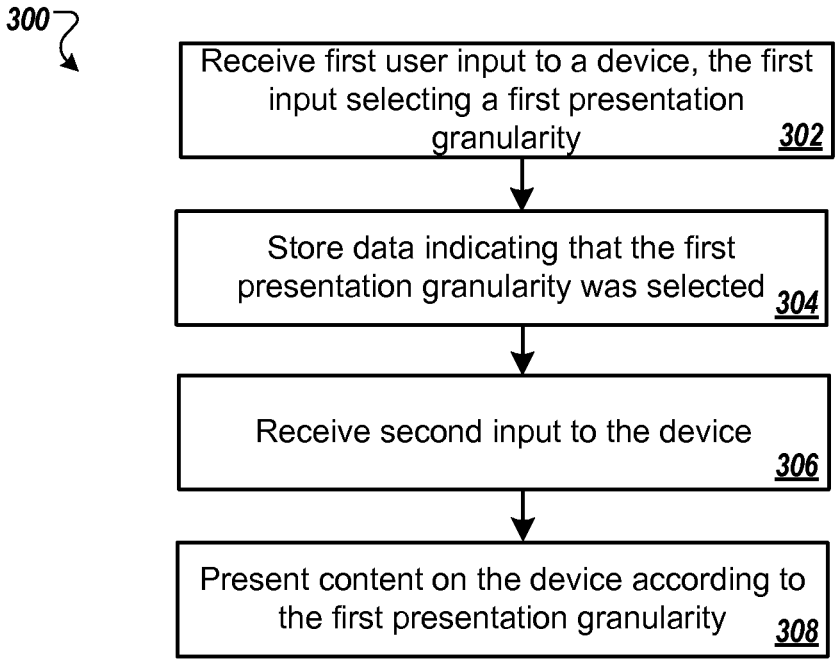
FIG. 3 is a flow diagram of an accessibility process for allowing a user to specify the granularity with which he or she wants content to be presented, and then presenting the content at that granularity.

FIG. 3 is a flow diagram of an accessibility process 300 for allowing a user to specify the granularity with which he or she wants content to be presented, and then presenting the content at that granularity. Accessibility process 300 is performed, for example, by assisted reading device 100 described above with reference to FIGS. 1A and 1B.

The process 300 begins by receiving first user input to a device (302). The first user input selects a first presentation granularity for content presented by the device. For example, the user can use a rotational touch gesture, as if turning a virtual knob or dial. With each turn, the device can provide feedback, e.g., audio, indicating which granularity the user has selected. For example, when the user makes a first rotational movement, the device can output audio speech saying "character," indicating that the granularity is a character granularity. When the user makes a subsequent second rotational movement, the device can output audio speech saying "word," indicating that the granularity is word granularity. When the user makes a subsequent third rotational movement, the device can output audio speech saying, "phrase," indicating that the granularity is phrase granularity. If the user makes no additional rotational inputs for at least a threshold period of time, the last granularity selected by the user is selected as the first presentation granularity. For example, if the user stopped making rotational movements after selecting phrase granularity, phrase granularity would be selected as the first presentation granularity. The user can select from various presentation granularities, including, for example, character, word, phrase, sentence, and paragraph.

Data indicating that the first presentation granularity was selected is stored (304). Second user input to the device is received (306). The second user input requests presentation of content by the device. For example, the user can use touch input to move forward and backwards through the content presented on the device at a desired granularity. For example, the user can use a single finger swipe down motion to move to the next item of content and a single finger swipe up motion to move to the previous item of content. The content on the device is presented according to the first presentation granularity (308). For example, if the input indicated that the next item of content (according to the first presentation granularity) should be presented, the next item at the first presentation granularity (e.g., the next character, word, phrase, sentence, etc.) is presented. If the input indicated that the previous item of content (according to the first presentation granularity) should be presented, the previous item is presented. The content is presented, for example, through synthesized speech.

In some implementations, before stepping forwards and backwards through the content, the user selects a line of interest. For example, the user can touch the display of the device to indicate a line of interest, and then use additional touch inputs to step through the line of interest. In other implementations, the user steps forwards and backwards through the content relative to a cursor that is moved with each input. For example, when a page is first displayed on the device, the cursor can be set at the top of the page. If the user provides input indicating that the next item of content should be presented, the first item of content on the page is presented. The cursor is updated to the last presented piece of content. This updating continues as the user moves forwards and backwards through the content.

If the cursor is at the beginning of the page and the user provides input indicating that the previous item of content should be presented, or if the cursor is at the end of the page and the user provides input indicating that the next item of content should be presented, the device provides feedback indicating that the cursor is already at the beginning (or end) of the page. For example, in some implementations, the device outputs a border sound. This alerts the user that he or she needs to turn the page before navigating to the desired item of content.

In some implementations, when the user hears an item of interest, the user can provide additional input requesting a menu for the item of interest. When the device receives that input, the device can present the menu. An example menu is described above with reference to FIG. 1B.

Example Software Architecture

Figure 4:
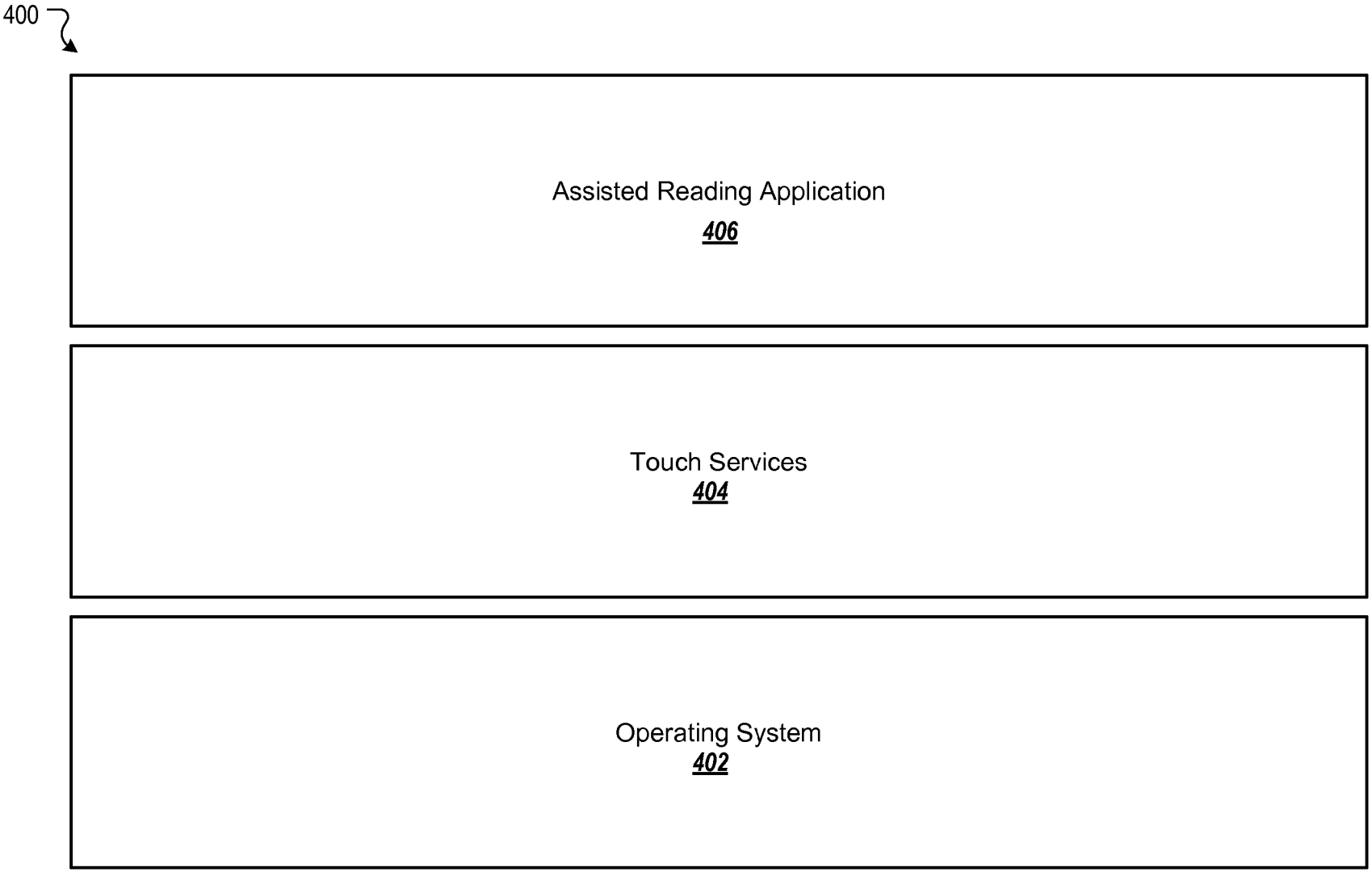
FIG. 4 illustrates an example software architecture for implementing the accessibility process and features of FIGS. 1-3.

FIG. 4 illustrates example software architecture 400 for implementing the accessibility processes and features of FIGS. 1-3. In some implementations, software architecture 400 can include operating system 402, touch services module 404, and reading application 406. This architecture can conceptually operate on top of a hardware layer (not shown).

Operating system 402 provides an interface to the hardware layer (e.g., a capacitive touch display or device). Operating system 402 can include one or more software drivers that communicate with the hardware. For example, the drivers can receive and process touch input signals generated by a touch sensitive display or device in the hardware layer. The operating system 402 can process raw input data received from the driver(s). This processed data can then be made available to touch services layer 405 through one or more application programming interfaces (APIs). These APIs can be a set of APIs that are included with operating systems (such as, for example, Linux or UNIX APIs), as well as APIs specific for sending and receiving data relevant to touch input.

Touch services module 405 can receive touch inputs from operating system layer 402 and convert one or more of these touch inputs into touch input events according to an internal touch event model. Touch services module 405 can use different touch models for different applications. For example, a reading application such as an ebook reader will be interested in events that correspond to input as described in reference to FIGS. 1-3, and the touch model can be adjusted or selected accordingly to reflect the expected inputs.

The touch input events can be in a format (e.g., attributes) that are easier to use in an application than raw touch input signals generated by the touch sensitive device. For example, a touch input event can include a set of coordinates for each location at which a touch is currently occurring on a drafting user interface. Each touch input event can include information on one or more touches occurring simultaneously.

In some implementations, gesture touch input events can also be detected by combining two or more touch input events. The gesture touch input events can contain scale and/or rotation information. The rotation information can include a rotation value that is a relative delta in degrees. The scale information can also include a scaling value that is a relative delta in pixels on the display device. Other gesture events are possible.

All or some of these touch input events can be made available to developers through a touch input event API. The touch input API can be made available to developers as a Software Development Kit (SDK) or as part of an application (e.g., as part of a browser tool kit).

Assisted reading application 406 can be an electronic book reading application executing on a mobile device (e.g., an electronic tablet). Assisted reading application 406 can include various components for receiving and managing input, generating user interfaces and performing audio output, for example, speech synthesis. Speech synthesis can be implemented using any known speech synthesis technology including but not limited to: concatenative synthesis, formant synthesis, diphone synthesis, domain-specific synthesis, unit selection synthesis, articulatory synthesis and Hidden Markov Model (HHM) based synthesis. These components can be communicatively coupled to one or more of each other. These components can be separate or distinct, two or more of the components may be combined in a single process or routine. The functional description provided herein including separation of responsibility for distinct functions is by way of example. Other groupings or other divisions of functional responsibilities can be made as necessary or in accordance with design preferences.

Example Device Architecture

Figure 5:
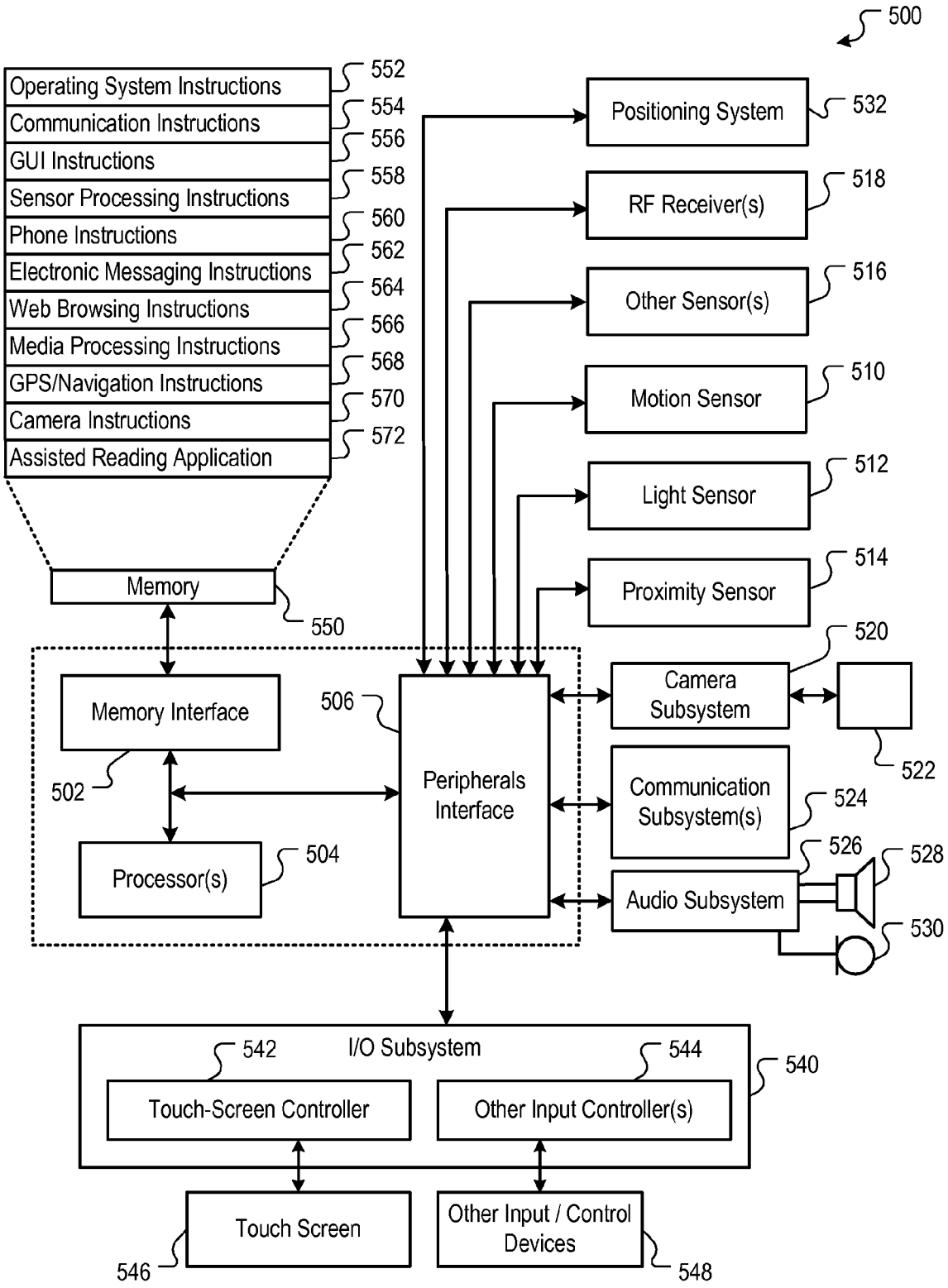
FIG. 5 is a block diagram of an exemplary hardware architecture for implementing the features and processes described in reference to FIGS. 1-4.

FIG. 5 is a block diagram of example hardware architecture of device 500 for implementing a reading application, as described in reference to FIGS. 1 and 2. Device 500 can include memory interface 502, one or more data processors, image processors and/or central processing units 505, and peripherals interface 506. Memory interface 502, one or more processors 505 and/or peripherals interface 506 can be separate components or can be integrated in one or more integrated circuits. The various components in device 500 can be coupled by one or more communication buses or signal lines.

Sensors, devices, and subsystems can be coupled to peripherals interface 506 to facilitate multiple functionalities. For example, motion sensor 510, light sensor 512, and proximity sensor 515 can be coupled to peripherals interface 506 to facilitate various orientation, lighting, and proximity functions. For example, in some implementations, light sensor 512 can be utilized to facilitate adjusting the brightness of touch screen 556. In some implementations, motion sensor 510 can be utilized to detect movement of the device. Accordingly, display objects and/or media can be presented according to a detected orientation, e.g., portrait or landscape.

Other sensors 516 can also be connected to peripherals interface 506, such as a temperature sensor, a biometric sensor, a gyroscope, or other sensing device, to facilitate related functionalities.

For example, device 500 can receive positioning information from positioning system 532. Positioning system 532, in various implementations, can be a component internal to device 500, or can be an external component coupled to device 500 (e.g., using a wired connection or a wireless connection). In some implementations, positioning system 532 can include a GPS receiver and a positioning engine operable to derive positioning information from received GPS satellite signals. In other implementations, positioning system 532 can include a compass (e.g., a magnetic compass) and an accelerometer, as well as a positioning engine operable to derive positioning information based on dead reckoning techniques. In still further implementations, positioning system 532 can use wireless signals (e.g., cellular signals, IEEE 802.11 signals) to determine location information associated with the device. Other positioning systems are possible.

Broadcast reception functions can be facilitated through one or more radio frequency (RF) receiver(s) 518. An RF receiver can receive, for example, AM/FM broadcasts or satellite broadcasts (e.g., XM® or Sirius® radio broadcast). An RF receiver can also be a TV tuner. In some implementations, RF receiver 518 is built into wireless communication subsystems 525. In other implementations, RF receiver 518 is an independent subsystem coupled to device 500 (e.g., using a wired connection or a wireless connection). RF receiver 518 can receive simulcasts. In some implementations, RF receiver 518 can include a Radio Data System (RDS) processor, which can process broadcast content and simulcast data (e.g., RDS data). In some implementations, RF receiver 518 can be digitally tuned to receive broadcasts at various frequencies. In addition, RF receiver 518 can include a scanning function which tunes up or down and pauses at a next frequency where broadcast content is available.

Camera subsystem 520 and optical sensor 522, e.g., a charged coupled device (CCD) or a complementary metal-oxide semiconductor (CMOS) optical sensor, can be utilized to facilitate camera functions, such as recording photographs and video clips.

Communication functions can be facilitated through one or more communication subsystems 525. Communication subsystem(s) 525 can include one or more wireless communication subsystems and one or more wired communication subsystems. Wireless communication subsystems can include radio frequency receivers and transmitters and/or optical (e.g., infrared) receivers and transmitters. Wired communication system can include a port device, e.g., a Universal Serial Bus (USB) port or some other wired port connection that can be used to establish a wired connection to other computing devices, such as other communication devices, network access devices, a personal computer, a printer, a display screen, or other processing devices capable of receiving and/or transmitting data. The specific design and implementation of communication subsystem 525 can depend on the communication network(s) or medium(s) over which device 500 is intended to operate. For example, device 500 may include wireless communication subsystems designed to operate over a global system for mobile communications (GSM) network, a GPRS network, an enhanced data GSM environment (EDGE) network, 802.x communication networks (e.g., WiFi, WiMax, or 3G networks), code division multiple access (CDMA) networks, and a Bluetooth™ network. Communication subsystems 525 may include hosting protocols such that device 500 may be configured as a base station for other wireless devices. As another example, the communication subsystems can allow the device to synchronize with a host device using one or more protocols, such as, for example, the TCP/IP protocol, HTTP protocol, UDP protocol, and any other known protocol.

Audio subsystem 526 can be coupled to speaker 528 and one or more microphones 530. One or more microphones 530 can be used, for example, to facilitate voice-enabled functions, such as voice recognition, voice replication, digital recording, and telephony functions.

I/O subsystem 550 can include touch screen controller 552 and/or other input controller(s) 555. Touch-screen controller 552 can be coupled to touch screen 556. Touch screen 556 and touch screen controller 552 can, for example, detect contact and movement or break thereof using any of a number of touch sensitivity technologies, including but not limited to capacitive, resistive, infrared, and surface acoustic wave technologies, as well as other proximity sensor arrays or other elements for determining one or more points of contact with touch screen 556 or proximity to touch screen 556.

Other input controller(s) 555 can be coupled to other input/control devices 558, such as one or more buttons, rocker switches, thumb-wheel, infrared port, USB port, and/or a pointer device such as a stylus. The one or more buttons (not shown) can include an up/down button for volume control of speaker 528 and/or microphone 530.

In one implementation, a pressing of the button for a first duration may disengage a lock of touch screen 556; and a pressing of the button for a second duration that is longer than the first duration may turn power to device 500 on or off. The user may be able to customize a functionality of one or more of the buttons. Touch screen 556 can, for example, also be used to implement virtual or soft buttons and/or a keyboard.

In some implementations, device 500 can present recorded audio and/or video files, such as MP3, AAC, and MPEG files. In some implementations, device 500 can include the functionality of an MP3 player.

Memory interface 502 can be coupled to memory 550. Memory 550 can include high-speed random access memory and/or non-volatile memory, such as one or more magnetic disk storage devices, one or more optical storage devices, and/or flash memory (e.g., NAND, NOR). Memory 550 can store operating system 552, such as Darwin, RTXC, LINUX, UNIX, OS X, WINDOWS, or an embedded operating system such as VxWorks. Operating system 552 may include instructions for handling basic system services and for performing hardware dependent tasks. In some implementations, operating system 552 can be a kernel (e.g., UNIX kernel).

Memory 550 may also store communication instructions 555 to facilitate communicating with one or more additional devices, one or more computers and/or one or more servers. Communication instructions 555 can also be used to select an operational mode or communication medium for use by the device, based on a geographic location (obtained by the GPS/Navigation instructions 568) of the device. Memory 550 may include graphical user interface instructions 556 to facilitate graphic user interface processing; sensor processing instructions 558 to facilitate sensor-related processing and functions (e.g., the touch services layer 404 described above with reference to FIG. 4); phone instructions 560 to facilitate phone-related processes and functions; electronic messaging instructions 562 to facilitate electronic-messaging related processes and functions; web browsing instructions 565 to facilitate web browsing-related processes and functions; media processing instructions 566 to facilitate media processing-related processes and functions; GPS/Navigation instructions 568 to facilitate GPS and navigation-related processes and instructions, e.g., mapping a target location; and camera instructions 570 to facilitate camera-related processes and functions. Reading application instructions 572 facilitate the features and processes, as described in reference to FIGS. 1-4. Memory 550 may also store other software instructions (not shown), such as web video instructions to facilitate web video-related processes and functions; and/or web shopping instructions to facilitate web shopping-related processes and functions. In some implementations, media processing instructions 566 are divided into audio processing instructions and video processing instructions to facilitate audio processing-related processes and functions and video processing-related processes and functions, respectively.

Each of the above identified instructions and applications can correspond to a set of instructions for performing one or more functions described above. These instructions need not be implemented as separate software programs, procedures, or modules. Memory 550 can include additional instructions or fewer instructions. Furthermore, various functions of device 500 may be implemented in hardware and/or in software, including in one or more signal processing and/or application specific integrated circuits.

Example Network Operating Environment for a Device

Figure 6:
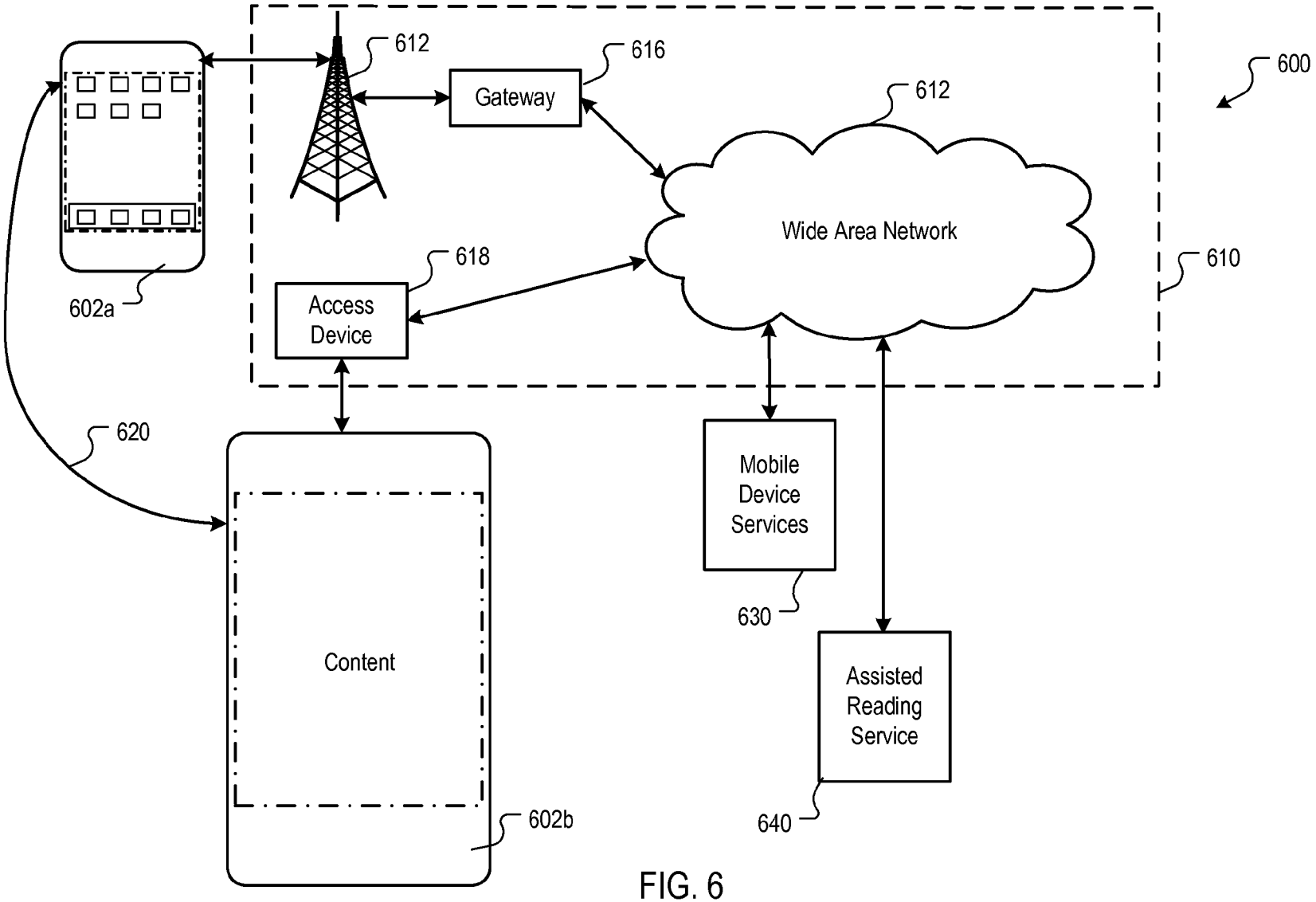
FIG. 6 is a block diagram of an exemplary network operating environment for the device of FIG. 5.

FIG. 6 is a block diagram of example network operating environment 600 for a device for implementing virtual drafting tools. Devices 602*a* and 602*b* can, for example, communicate over one or more wired and/or wireless networks 610 in data communication. For example, wireless network 612, e.g., a cellular network, can communicate with a wide area network (WAN) 615, such as the Internet, by use of gateway 616. Likewise, access device 618, such as an 502.11 g wireless access device, can provide communication access to the wide area network 615. In some implementations, both voice and data communications can be established over wireless network 612 and access device 618. For example, device 602*a* can place and receive phone calls (e.g., using VoIP protocols), send and receive e-mail messages (e.g., using POP3 protocol), and retrieve electronic documents and/or streams, such as web pages, photographs, and videos, over wireless network 612, gateway 616, and wide area network 615 (e.g., using TCP/IP or UDP protocols). Likewise, in some implementations, device 602*b* can place and receive phone calls, send and receive e-mail messages, and retrieve electronic documents over access device 618 and wide area network 615. In some implementations, devices 602*a* or 602*b* can be physically connected to access device 618 using one or more cables and access device 618 can be a personal computer. In this configuration, device 602*a* or 602*b* can be referred to as a "tethered" device.

Devices 602*a* and 602*b* can also establish communications by other means. For example, wireless device 602*a* can communicate with other wireless devices, e.g., other devices 602*a* or 602*b*, cell phones, etc., over wireless network 612. Likewise, devices 602*a* and 602*b* can establish peer-to-peer communications 620, e.g., a personal area network, by use of one or more communication subsystems, such as a Bluetooth™ communication device. Other communication protocols and topologies can also be implemented.

Devices 602*a* or 602*b* can, for example, communicate with one or more services over one or more wired and/or wireless networks 610. These services can include, for example, mobile services 630 and assisted reading services 650. Mobile services 630 provide various services for mobile devices, such as storage, syncing, an electronic store for downloading electronic media for user with the reading application (e.g., ebooks) or any other desired service. Assisted reading service 650 provides a web application for providing an assisted reading application as described in reference to FIGS. 1-5.

Device 602*a* or 602*b* can also access other data and content over one or more wired and/or wireless networks 610. For example, content publishers, such as news sites, RSS feeds, web sites, blogs, social networking sites, developer networks, etc., can be accessed by device 602*a* or 602*b*. Such access can be provided by invocation of a web browsing function or application (e.g., a browser) in response to a user touching, for example, a Web object.

The features described can be implemented in digital electronic circuitry, or in computer hardware, firmware, software, or in combinations of them. The features can be implemented in a computer program product tangibly embodied in an information carrier, e.g., in a machine-readable storage device, for execution by a programmable processor; and method steps can be performed by a programmable processor executing a program of instructions to perform functions of the described implementations by operating on input data and generating output. Alternatively or in addition, the program instructions can be encoded on a propagated signal that is an artificially generated signal, e.g., a machine-generated electrical, optical, or electromagnetic signal, that is generated to encode information for transmission to suitable receiver apparatus for execution by a programmable processor.

The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language (e.g., Objective-C, Java), including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors or cores, of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network. The relationship of client and server arises by virtue of computer programs running on the respective computers and having a client-server relationship to each other.

One or more features or steps of the disclosed embodiments can be implemented using an Application Programming Interface (API). An API can define on or more parameters that are passed between a calling application and other software code (e.g., an operating system, library routine, function) that provides a service, that provides data, or that performs an operation or a computation.

The API can be implemented as one or more calls in program code that send or receive one or more parameters through a parameter list or other structure based on a call convention defined in an API specification document. A parameter can be a constant, a key, a data structure, an object, an object class, a variable, a data type, a pointer, an array, a list, or another call. API calls and parameters can be implemented in any programming language. The programming language can define the vocabulary and calling convention that a programmer will employ to access functions supporting the API.

In some implementations, an API call can report to an application the capabilities of a device running the application, such as input capability, output capability, processing capability, power capability, communications capability, etc.

A number of implementations have been described. Nevertheless, it will be understood that various modifications may be made. For example, while audio output such as speech synthesization is described above, other modes of providing information to users, for example, outputting information to Braille devices, can alternatively or additionally be used. As another example, elements of one or more implementations may be combined, deleted, modified, or supplemented to form further implementations. As yet another example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method performed by one or more processors of an assisted reading device, the method comprising:

providing a user interface on a display of the assisted reading device, the user interface displaying text of a content item and configured to distinguish between a first type of gesture for selecting a continuous assisted reading mode and a second type of gesture for selecting an enhanced assisted reading mode of the device and a respective portion of the displayed text to be read in the enhanced assisted reading mode;

receiving a first touch input on the user interface;

upon determining, based on the first touch input, that the first type of gesture has been entered:

invoking the continuous assisted reading mode; and continuously outputting audio for each word in a currently displayed portion and all subsequent portions of the content item until an end of the content item is reached or a user input for stopping or pausing the continuous assisted reading mode is received; and upon determining, based on the first touch input, that the second type of gesture has been entered:

invoking the enhanced assisted reading mode;

receiving a second touch input for selecting a desired level of reading granularity;

configuring the assisted reading device to provide the selected level of reading granularity;

based on a location of the first touch input on the user interface and the selected level of granularity, selecting the respective portion of the displayed text to be read in the enhanced assisted reading mode; and outputting audio for each word in the selected portion of the displayed text.

2. The method of claim 1, further comprising:

providing a granularity control for selecting a desired level of granularity corresponding to a sentence, word or character in the content item.

3. The method of claim 1, further comprising:

receiving a third touch input causing display of one or more options associated with a word in the selected portion of the displayed text.

4. The method of claim 3, where the one or more options includes receiving a definition of the word.

5. The method of claim 3, where the one or more options includes performing a search on a network or in the text using the word as a search query.

6. The method of claim 1, further comprising:

receiving a fourth touch input causing a next page of text to be presented.

7. The method of claim 6, further comprising:

outputting audio indicating the turning of the page.

8. The method of claim 1, further comprising:

outputting audio indicating when text describing a chapter or section title is encountered when generating the synthesized speech.

9. The method of claim 1, further comprising:

outputting audio corresponding to caption text describing an image embedded within the text that is encountered during the text reading.

10. A system for providing assisted reading, comprising:

one or more processors; and memory storing instructions, which, when executed by the one or more processors cause the one or more processors to perform operations comprising:

providing a user interface on a display of the assisted reading device, the user interface displaying text of a content item and configured to distinguish between a first type of gesture for selecting a continuous assisted reading mode and a second type of gesture for selecting an enhanced assisted reading mode and a respective portion of the displayed text to be read in the enhanced assisted reading mode;

receiving a first touch input on the user interface;

upon determining, based on the first touch input, that the first type of gesture has been entered:

invoking the continuous assisted reading mode; and continuously outputting audio for each word in a currently displayed portion and all subsequent portions of the content item until an end of the content item is reached or a user input for stopping or pausing the continuous assisted reading mode is received; and upon determining, based on the first touch input, that the second type of gesture has been entered:

invoking the enhanced assisted reading mode;

receiving a second touch input for selecting a desired level of reading granularity;

configuring the assisted reading device to provide the selected level of reading granularity;

based on a location of the first touch input on the user interface and the selected level of granularity, selecting the respective portion of the displayed text to be read in the enhanced assisted reading mode; and outputting audio for each word in the selected portion of the displayed text.

11. The system of claim 10, where the memory further comprises instructions, which, when executed by the one or more processors, cause the one or more processors to perform operations comprising:

providing a granularity control for selecting a desired level of granularity corresponding to a sentence, word or character in the content item.

12. The system of claim 10, where the memory further comprises instructions, which, when executed by the one or more processors, causes the one or more processors to perform operations comprising:

receiving a third touch input causing display of one or more options associated with a word in the selected portion of the displayed text.

13. The system of claim 12, where the one or more options includes receiving a definition of the word.

14. The system of claim 12, where the one or more options includes performing a search on a network or in the text using the word as a search query.

15. The system of claim 10, where the memory further comprises instructions, which, when executed by the one or more processors, causes the one or more processors to perform operations comprising:

receiving a fourth touch input causing a next page of text to be presented.

16. The system of claim 15, where the memory further comprises instructions, which, when executed by the one or more processors, causes the one or more processors to perform operations comprising:

outputting audio indicating the turning of the page.

17. The system of claim 10, where the memory further comprises instructions, which, when executed by the one or more processors, cause the one or more processors to perform operations comprising:

outputting audio indicating when text describing a chapter or section title is encountered when generating the synthesized speech.

18. The system of claim 10, where the memory further comprises instructions, which, when executed by the one or more processors, cause the one or more processors to perform operations comprising:

outputting audio corresponding to caption text describing an image embedded within the text that is encountered during the text reading.

19. A non-transitory computer-readable medium having instructions stored thereon, the instructions when executed by one or more processors cause the processors to perform operations comprising:

providing a user interface on a display of an assisted reading device, the user interface displaying text of a content item and configured to distinguish between a first type of gesture for selecting a continuous assisted reading mode and a second type of gesture for selecting an enhanced assisted reading mode of the device and a respective portion of the displayed text to be read in the enhanced assisted reading mode;

receiving a first touch input on the user interface;

upon determining, based on the first touch input, that the first type of gesture has been entered:

invoking the continuous assisted reading mode; and continuously outputting audio for each word in a currently displayed portion and all subsequent portions of the content item until an end of the content item is reached or a user input for stopping or pausing the continuous assisted reading mode is received; and upon determining, based on the first touch input, that the second type of gesture has been entered:

invoking the enhanced assisted reading mode;

receiving a second touch input for selecting a desired level of reading granularity;

configuring the assisted reading device to provide the selected level of reading granularity;

based on a location of the first touch input on the user interface and the selected level of granularity, selecting the respective portion of the displayed text to be read in the enhanced assisted reading mode; and outputting audio for each word in the selected portion of the displayed text.

20. The computer-readable medium of claim 19, wherein the operations further comprise:

providing a granularity control for selecting a desired level of granularity corresponding to a sentence, word or character in the content item.

21. The computer-readable medium of claim 19, wherein the operations further comprise:

receiving a third touch input causing display of one or more options associated with a word in the selected portion of the displayed text.

22. The computer-readable medium of claim 21, where the one or more options includes receiving a definition of the word.

23. The computer-readable medium of claim 21, where the one or more options includes performing a search on a network or in the text using the word as a search query.

24. The computer-readable medium of claim 19, wherein the operations further comprise:

receiving a fourth touch input causing a next page of text to be presented.

25. The computer-readable medium of claim 24, wherein the operations further comprise:

outputting audio indicating the turning of the page.

26. The computer-readable medium of claim 19, wherein the operations further comprise:

outputting audio indicating when text describing a chapter or section title is encountered when generating the synthesized speech.

27. The computer-readable medium of claim 19, wherein the operations further comprise:

outputting audio corresponding to caption text describing an image embedded within the text that is encountered during the text reading.

28. A computer-implemented method, comprising:

receiving a first user input to a device, the first user input selecting a first presentation granularity for content presented by the device, wherein receiving the first user input further comprises:

receiving multiple rotational inputs on a touch-sensitive surface from the user;

presenting a granularity option to the user after each rotational input, wherein each granularity option corresponds to a respective presentation granularity;

determining that no additional rotational input is received during a period of time after a last granularity option is presented to the user; and selecting the respective presentation granularity corresponding to the last granularity option as the first presentation granularity;

storing data indicating that the first presentation granularity was selected;

receiving a second user input to the device, the second user input requesting presentation of the content; and presenting the content according to the first presentation granularity.

29. The method of claim 28, wherein the first presentation granularity is a word granularity, and the first item of the content is a word, the method further comprising:

receiving third user input requesting a menu of options for the first item of content; and presenting a menu in response to the third user input, wherein the menu includes one or more options for the first item of content.

30. The method of claim 28, wherein the first presentation granularity is one of a character granularity, a word granularity, a phrase granularity, a sentence granularity, or a paragraph granularity.

31. A system for providing assisted reading, comprising:

one or more processors; and memory storing instructions, which, when executed by the one or more processors cause the one or more processors to perform operations comprising:

receiving a first user input to a device, the first user input selecting a first presentation granularity for content presented by the device, wherein receiving the first user input further comprises:

receiving multiple rotational inputs on a touch-sensitive surface from the user;

presenting a granularity option to the user after each rotational input, wherein each granularity option corresponds to a respective presentation granularity;

determining that no additional rotational input is received during a period of time after a last granularity option is presented to the user; and selecting the respective presentation granularity corresponding to the last granularity option as the first presentation granularity;

storing data indicating that the first presentation granularity was selected;

receiving a second user input to the device, the second user input requesting presentation of the content; and presenting the content according to the first presentation granularity.

32. The system of claim 31, wherein the first presentation granularity is a word granularity, and the first item of the content is a word, the operations further comprise:

receiving third user input requesting a menu of options for the first item of content; and presenting a menu in response to the third user input, wherein the menu includes one or more options for the first item of content.

33. The system of claim 31, wherein the first presentation granularity is one of a character granularity, a word granularity, a phrase granularity, a sentence granularity, or a paragraph granularity.

34. A non-transitory computer-readable medium storing instructions, which, when executed by one or more processors cause the one or more processors to perform operations comprising:

receiving a first user input to a device, the first user input selecting a first presentation granularity for content presented by the device, wherein receiving the first user input further comprises:

receiving multiple rotational inputs on a touch-sensitive surface from the user;

presenting a granularity option to the user after each rotational input, wherein each granularity option corresponds to a respective presentation granularity;

determining that no additional rotational input is received during a period of time after a last granularity option is presented to the user; and selecting the respective presentation granularity corresponding to the last granularity option as the first presentation granularity;

storing data indicating that the first presentation granularity was selected;

receiving a second user input to the device, the second user input requesting presentation of the content; and presenting the content according to the first presentation granularity.

35. The computer-readable medium of claim 34, wherein the first presentation granularity is a word granularity, and the first item of the content is a word, the operations further comprise:

receiving third user input requesting a menu of options for the first item of content; and presenting a menu in response to the third user input, wherein the menu includes one or more options for the first item of content.

36. The computer-readable medium of claim 34, wherein the first presentation granularity is one of a character granularity, a word granularity, a phrase granularity, a sentence granularity, or a paragraph granularity.

* * * * *